US007188440B2

(12) United States Patent
Hofland

(10) Patent No.: US 7,188,440 B2
(45) Date of Patent: Mar. 13, 2007

(54) DEVICE AND METHOD FOR BRINGING ASHORE OR REFLOATING A FLOATING BODY

(76) Inventor: Jacobus Maria Josef Hofland, Korte Molenweg 5, NL-1842 EE Oterleek (NL)

( * ) Notice: Subject to any disclaimer, the term of this patent is extended or adjusted under 35 U.S.C. 154(b) by 0 days.

(21) Appl. No.: 10/443,803

(22) Filed: May 23, 2003

(65) Prior Publication Data

US 2004/0016386 A1 Jan. 29, 2004

(30) Foreign Application Priority Data

May 24, 2002 (NL) ..... 1020674

(51) Int. Cl.
*B63C 7/22* (2006.01)

(52) U.S. Cl. ..... 37/317; 37/313

(58) Field of Classification Search ..... 37/307–346, 37/304; 405/17–34, 222, 223, 303; 299/7–9, 299/18, 39; 114/264
See application file for complete search history.

(56) References Cited

U.S. PATENT DOCUMENTS

| | | | | |
|---|---|---|---|---|
| 328,095 A | | 10/1885 | Walsh | |
| 1,019,610 A | | 3/1912 | Donnelly | |
| 3,161,438 A | | 12/1964 | Novak | |
| 4,073,078 A | * | 2/1978 | Leitz | 37/342 |
| 4,076,313 A | | 2/1978 | Sperandeo, III | |
| 4,108,499 A | | 8/1978 | Sandberg | |
| 4,584,784 A | | 4/1986 | Wolters et al. | |
| 4,585,274 A | * | 4/1986 | Grable | 299/7 |
| 4,587,064 A | | 5/1986 | Blum | |
| 5,300,219 A | * | 4/1994 | Braid | 210/122 |
| 5,595,134 A | | 1/1997 | Pete | |
| 5,775,836 A | * | 7/1998 | Dean, Jr. | 405/17 |

FOREIGN PATENT DOCUMENTS

| | | |
|---|---|---|
| DE | 3441 452 | 3/1986 |
| EP | 0 592 268 | 4/1994 |

* cited by examiner

*Primary Examiner*—Thomas B. Will
*Assistant Examiner*—Alicia Torres
(74) *Attorney, Agent, or Firm*—Young & Thompson

(57) ABSTRACT

An earthmoving device is suspended from a floating body provided with a hull. To that end, suspension elements for suspending the earthmoving device in a movable manner along the outside of the hull are provided, for the purpose of carrying out operations on the water bed. In this way the floating body can be refloated after running aground, or can be brought ashore.

21 Claims, 2 Drawing Sheets

DEVICE AND METHOD FOR BRINGING ASHORE OR REFLOATING A FLOATING BODY

FIELD OF THE INVENTION

The invention relates to moving a floating body that is in such shallow water that the hull of said floating body is touching the water bed. The floating body can be a ship or pontoon and the like that has been deliberately run aground, for example for the purpose of loading and unloading goods, or of landing armed forces or heavy equipment etc.

BACKGROUND OF THE INVENTION

In that connection it is known to deepen the bed directly underneath and next to the vessel, in such a way that the floating power of the floating body is restored and/or is retained and the floating body can be moved or can move in a state already afloat. The floating body in this case can be propelled by its own drive, or it can be towed away by, for example, a tug, or by a combination of the two. Furthermore, a stranded floating body can be towed into the open sea in this way. The bed can be deepened only at ebb tide, in such a way that mobile excavating machines can reach the vessel.

The disadvantage of this is that deepening the bottom in this way is not always possible. In particular, in poor weather conditions such as in the case of storms and high water levels, it is impossible to bring ashore or refloat the floating body in this way.

EP-A-214683 discloses a device which is mobile over a water bed, for the purpose of carrying out operations such as burying a line. This known device may be connected to a vessel anchored in the vicinity. That vessel remains in sufficiently deep water, while the device can move into shallower water and into the surf.

This known device is likewise not very suitable for bringing ashore or refloating a stranded vessel. First of all, there are problems with travelling over the water bed, which usually has an unknown contour. Furthermore, the device is fairly voluminous and heavy, which makes manoeuvring difficult and entails the risk of sinking into the water bed, The swell and deteriorating weather conditions can have an adverse effect on the functioning of the device.

SUMMARY OF THE INVENTION

The object of the invention is to provide a solution to this problem. To that end, the invention relates to, in combination, a floating body provided with a hull, an earthmoving device and means for supporting the earthmoving device on the hull and for moving the earthmoving device in the longitudinal direction along the outside of the hull, for the purpose of carrying out operations on the water bed.

According to the invention, the earthmoving device is supported on the floating body itself, so that the disadvantages of travelling over the water bed no longer exist. Since, furthermore, a mobile undercarriage is no longer necessary, the earthmoving device can also be simpler and lighter. Moreover, it can operate virtually continuously, because the support by the floating body is very stable. The area that can be reached by this earthmoving device extends around the vessel, so that a sufficiently broad trench, in which the vessel can be moved, can be formed in the water bed. The device cam be continuously operational.

The earthmoving device is preferably a sand extraction plant, provided with a pump that is drivable by a motor, a suction pipe that is in fluid connection with the pump for the purpose of extracting a sand/water mixture from the water bed, and a discharge pipe for the extracted sand/water mixture.

The earthmoving device may be suspended from the floating body in various ways. According to a first possibility, a rigid guide, for example a rail, is provided on the floating body for that purpose. This rail can extend around the entire hull of the floating body. The earthmoving device is suspended from such a rigid guide and is movable along it by means of a drive unit. Said drive unit can be fitted on the earthmoving device, but it can also be fitted on the hull.

Alternatively, the earthmoving device can be suspended from the hull by means of at least one cable, chain and the like, and can also be movable along the hull by means of that cable and chain. In that connection, at least one hoisting device is provided, for the purpose of paying out or hauling in the cable or chain.

It is preferable also to provide a second hoisting device and a second cable or chain interacting with it, for the purpose of paying out or hauling in the second cable or chain. By means of these hoisting devices, the sand exaction plant can be moved both upwards and in the longitudinal direction of the vessel, The sand extraction plant can also be moved around the front side and the rear side of the hull.

The invention further relates to a method for moving a floating body in a body of water, the depth of which is less than the draught of the floating body, comprising the following steps:

- providing a device for carrying out operations on the bed of the body of water;
- suspending the device from the outside of the floating body;
- moving the device along the floating body;
- carrying out the operations on the bed of the body of water at several positions along the floating body, for the purpose of restoring and/or retaining the floating power of said floating body.

BRIEF DESCRIPTION OF THE DRAWINGS

The invention will be explained in greater detail below with reference to an exemplary embodiment illustrated in the figures.

DETAILED DESCRIPTION OF THE INVENTION

Figure 2:
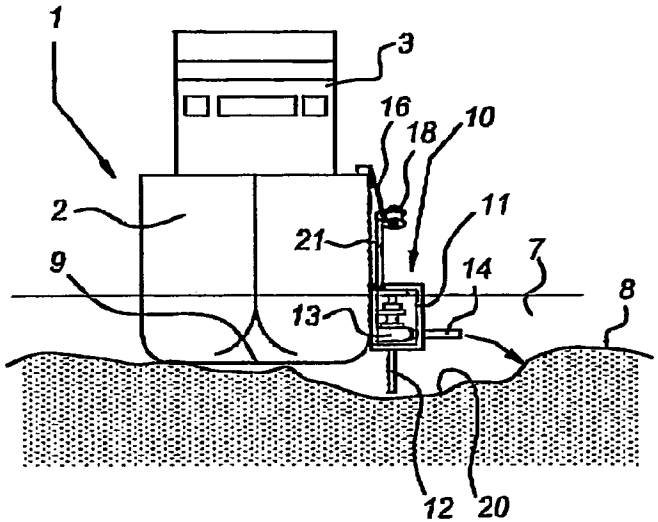
FIG. 2 shows the vessel with the ea moving device, in front view.
Figure 1:
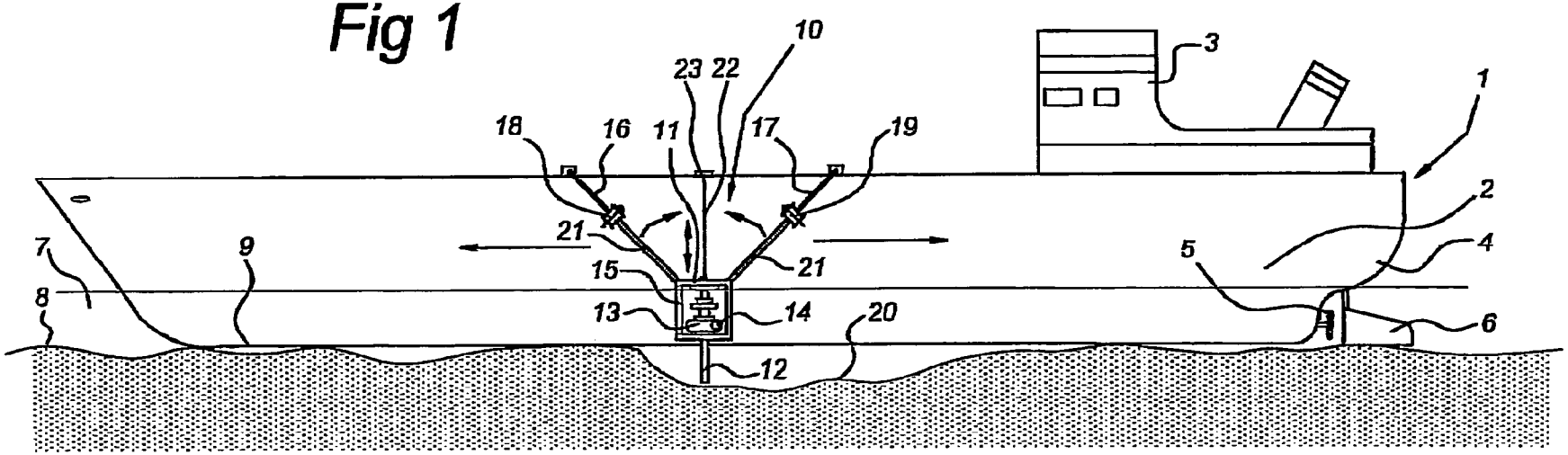
FIG. 1 shows a vessel with the earthmoving device according to the invention, in side view.

The vessel shown in FIG. 1 has in the usual manner a hull 2 provided with a superstructure 3. A screw 5 and rudder 6 are situated in the known manner on the rear side 4 of the hull 2.

In the example shown in FIG. 1 the vessel 1 is situated in a body of water 7, in which the depth to the bed 8 is less than the normal draught of the vessel 1. It is therefore lying with the keel 9 on the bed 8.

In order to restore and/or to retain the floating power of the vessel 1, the depth of the body of water 7 must be increased, which means that the bed 8 must be deepened locally. To this end, according to the invention, an earthmoving device 10 is fitted on the outside of the hull 2. Said earthmoving device in the present example comprises a sand extraction plant 11 with a suction pipe 12 for extracting a sand/water mixture, a pump 13 and a discharge pipe 14. Said discharge pipe 14 may be oriented in various directions, for example about a vertical axis in such a way that the sand/water mixture can be discharged in the desired direction.

The earthmoving device 10 further comprises a frame 15, which is suspended by means of cables 16, 17 from the vessel 1. Two swivelling arms 21 are connected to the frame 15, on the free end of which swivelling arms a hoisting device 18, 19 is situated. The cables 16, 17 can be hauled in and paid out respectively by these hoisting devices, in such a way that the desired horizontal movement and/or vertical movement of the sand extraction plant can be achieved.

The earthmoving device 10 can be moved up and down, and also forwards and backwards along the hull, by operating the hoisting devices 18, 19 correctly. As a result of such movement, a deepened bed part 20 can be formed locally, which bed part eventually extends around the entire vessel 1. By means of the hoisting devices 18, 19, positioning can be such that the earthmoving device can also be moved around the front side and the rear side 4 of the vessel 1. By subsequently moving the vessel 1 and continuing the earthmoving operations, it is therefore possible to reach the open sea again, The pump 13 with suction pipe 12 can be rotated about a vertical axis, for the purpose of burrowing out the bed material.

The earthmoving device can be used not only for refloating and for bringing ashore, but also for deliberately running a vessel aground on a sandy shore. Said shore can be used, for example, in those cases where there is no harbour in the vicinity, such as, for example, for the purpose of landing heavy equipment, armed forces etc.

The sand extraction plant can also be equipped with a sand pump which operates at such pressure that it is possible to work with a limited length of delivery pipe. Owing to the higher pressure, if a pressure nozzle is provided on the end of the delivery pipe, the water/sand mixture can be pumped away 25 to 50 metres from the ship.

Figure 3:
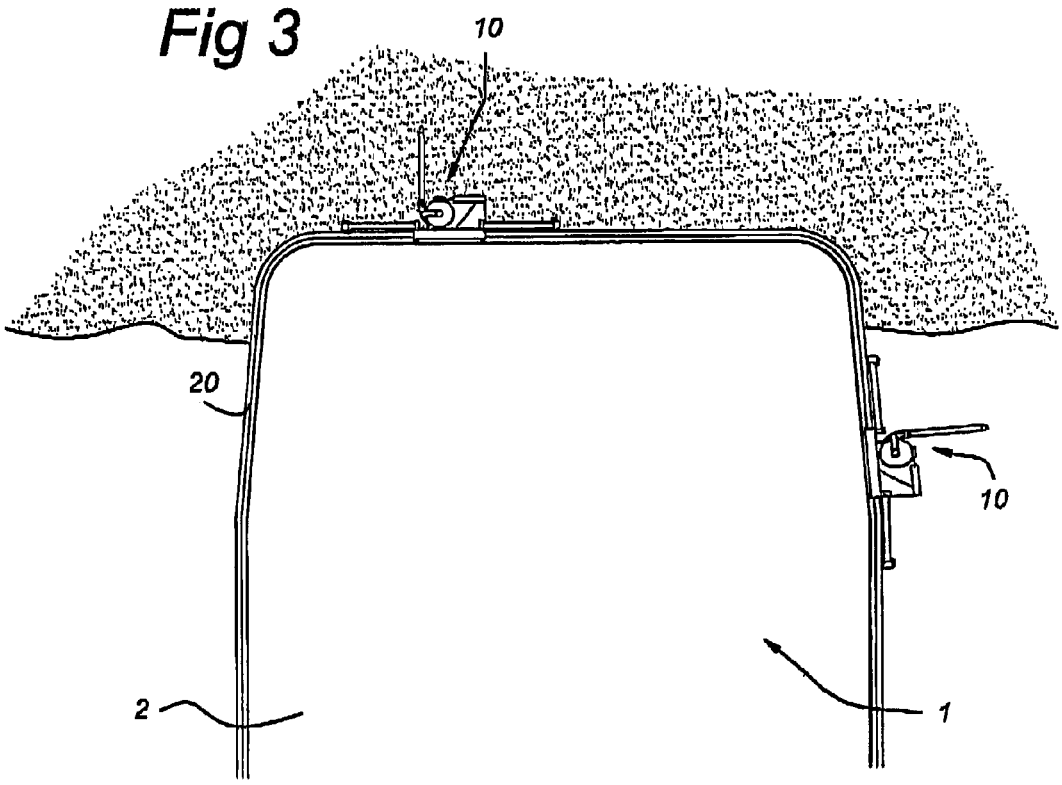
FIG. 3 shows a top view of an alternative embodiment.
Figure 4:
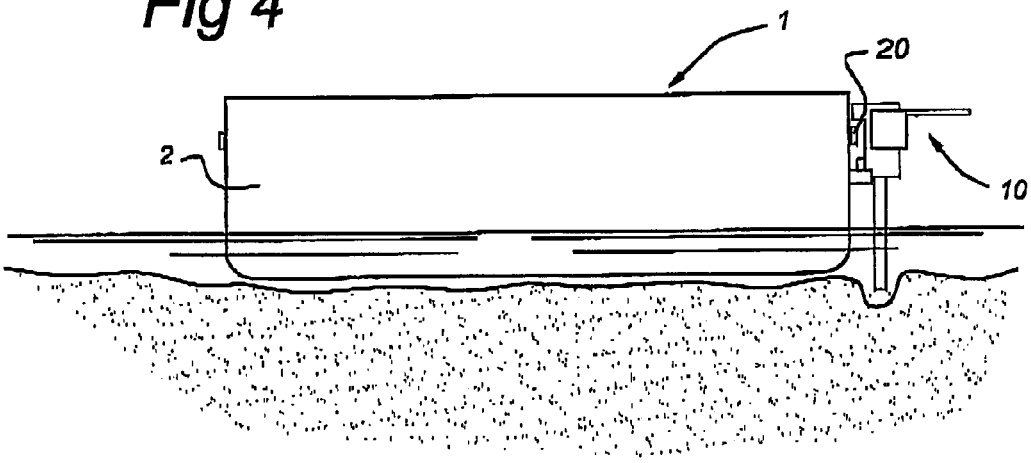
FIG. 4 shows the front view of the embodiment of FIG. 3.

In the embodiment of FIGS. 3 and 4 a rigid guide in the form of a rail 20 is fitted on the outside of the hull 2 of the floating body 1. Said rail 20 can extend all around the hull 2.

The earthmoving device 10 is suspended so as to be movable along said rail 20. As shown in FIG. 3, e earthmoving device 10 is situated on the front side of the floating body 1 when it is brought ashore. It is also shown that more than one earthmoving device 10 can be used on the floating body 1.

It is observed that other embodiments are possible apart from the examples described before related to the suspension of the earthmoving device on the outside of the hull. For instance, it is possible to position a hoisting crane on the deck of the floating body, the earthmoving device being suspended on the hoisting cable at the outside of the hull. The hoisting crane is movable over the deck, in such a way that the earthmoving device is displaceable along the hull.

The invention claimed is:

1. In combination:

a floating body with a hull having an outer perimeter with an exterior facing outermost wall;

an earthmoving device for extracting water and sand from a water bed, said earthmoving device being movably positioned at a movable single location opposite said exterior facing outermost wall and being in fluid communication, at the single location, with the water bed to move extracted water and sand past the single location;

a support connected to said earthmoving device, said support enabling said earthmoving device to be movable adjacently alongside said exterior wall and correspondingly to move the single location of the fluid communication with the water bed adjacently alongside said exterior wall; and a moving element operatively connected to said support, wherein, in use carrying out operations on the water bed, said moving element moves said support and said earthmoving device in a longitudinal direction adjacently alongside said exterior wall so that the single location of fluid communication is moved correspondingly alongside said exterior wall.

2. The combination of claim 1, wherein said moving element moves said earthmoving device from one side of said floating body to an opposing side of said floating body.

3. The combination of claim 2, wherein said moving element moves said earthmoving device moves said earthmoving device in a vertical direction, relative to said longitudinal direction, adjacently alongside said exterior wall.

4. The combination according to claim 2, wherein said support suspends said earthmoving device from a rigid guide along the outside of the hull, and said moving element moves said support and said earthmoving device along said rigid guide.

5. The combination according to claim 4, wherein said rigid guide is a rail which extends around the outer periphery of the hull from a first side of the floating body to a second side of the floating body.

6. The combination of claim 5, wherein said rail enables said support and said earthmoving device to be movable from one side of said floating body, around the stern of the floating body, and to another side of the floating body.

7. The combination of claim 6, wherein said rail extends continuously around the outer periphery of the hull.

8. The combination of claim 1, wherein said earthmoving device comprises at least one sand extraction plant providing said fluid communication with the water bed, and said support enables movement of said sand extraction plant along said exterior wall.

9. The combination of claim 8, wherein said sand extraction plant comprises i) a pump drivable by a motor, ii) a suction line in fluid connection with the pump for extracting a sand/water mixture and provides said fluid communication with the water bed, and iii) a discharge pipe for discharging the extracted sand/water mixture.

10. The combination according to claim 1, wherein, said support comprises at least one cable that suspends said earthmoving device, and said at least one cable enables said earthmoving device to be movable along the hull while being suspended by at least one cable.

11. The combination according to claim 10, wherein said moving element comprises at least one hoisting device for paying out or hauling in said at least one cable.

12. The combination according to claim 11, wherein, said support comprises a second cable that suspends said earthmoving device, said moving the earthmoving device comprises a second hoisting device, and said second cable interacts with said second hoisting device for paying out or hauling in the second cable and moving said earthmoving device in a vertical direction relative to said longitudinal direction adjacently alongside said exterior facing wall.

13. The combination according to claim 11, wherein said at least one hoisting device is fitted on said earthmoving device.

14. The combination according to claim 11, wherein said at least one hoisting device is fitted on said floating body.

15. The combination according to claim 12, wherein said at least said first or second hoisting device is movable along the hull of said floating body.

16. The combination according to claim 11, wherein said earthmoving device comprises at least one arm having a free end on which free end said one hoisting device is situated.

17. The combination according to claim 16, wherein said earthmoving device comprises a frame, and each arm is connected in a swiveling manner to said frame.

18. An earthmoving device, comprising:

at least one sand extraction plant provided with a pump that is drivable by a motor, a suction line in fluid communication with the pump for extracting a mixture of sand and water, and a discharge pipe for discharging the extracted mixture of sand and water;

at least one means for suspending said extraction plant on an exterior facing outermost wall of the outer perimeter of a hull of a floating vessel so that said extraction plant is located at a single position relative to said hull any given time; and means for moving said means for suspending said extraction plant and said extraction plant from position to position in the longitudinal direction on the outside of the hull adjacently alongside the exterior facing outermost wall.

19. The earthmoving device according to claim 18, wherein said means for moving enables movement of said sand extraction plant from one side of the floating vessel to an opposing side of the floating vessel.

20. A method for moving a floating body in a body of water whose depth is less than the draft of the floating body, comprising the following steps:

providing an earthmoving device for carrying out operations on the bed of the body of water, said earthmoving device providing fluid communication with the water bed;

supporting said earthmoving device opposite an exterior facing outermost wall of the outer perimeter of the floating body so that said earthmoving device is positioned along the floating body relative to the exterior facing outermost wall and has fluid communication with the water bed at a single location of the water bed;

moving said earthmoving device on the outside of the floating body adjacently alongside the exterior facing outermost wall so that the location of fluid communication with the water bed correspondingly moves adjacently alongside the wall; and restoring and/or retaining the floating power of the floating body by carrying out the operations on the water bed by moving said earthmoving device to plural positions along the exterior facing outermost wall, the movement of said earthmoving device correspondingly moving the location of the fluid communication with the water bed to plural locations.

21. The method according to claim 20, further comprising forming a deepened water bed part next to and/or underneath the floating body.

* * * * *